US011091335B2

(12) United States Patent
Kuramura et al.

(10) Patent No.: US 11,091,335 B2
(45) Date of Patent: Aug. 17, 2021

(54) BRIDGE MODULE GUIDES

(71) Applicant: Hewlett-Packard Development Company, L.P., Spring, TX (US)

(72) Inventors: Kevin K Kuramura, Vancouver, WA (US); Devin S Uehling, Vancouver, WA (US); Kevin Lo, Vancouver, WA (US); Devin Knowles, Vancouver, WA (US); Kevin Witkoe, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/651,190

(22) PCT Filed: Oct. 19, 2017

(86) PCT No.: PCT/US2017/057396
§ 371 (c)(1),
(2) Date: Mar. 26, 2020

(87) PCT Pub. No.: WO2019/078869
PCT Pub. Date: Apr. 25, 2019

(65) Prior Publication Data

US 2020/0270082 A1 Aug. 27, 2020

(51) Int. Cl.
*B65H 5/06* (2006.01)
*B65H 5/38* (2006.01)

(52) U.S. Cl.
CPC ..... *B65H 5/062* (2013.01); *B65H 5/38* (2013.01); *B65H 2402/441* (2013.01);
(Continued)

(58) Field of Classification Search
CPC ..... B65H 2404/144; B65H 2404/1441; B65H 2404/1442; B65H 2601/11;
(Continued)

(56) References Cited

U.S. PATENT DOCUMENTS 5,461,460 A 10/1995 Lee et al.
7,330,682 B2 * 2/2008 Shinshi ..... G03G 15/2035 399/122
(Continued)

FOREIGN PATENT DOCUMENTS

EP 2070711 B1 6/2009
JP 2002356021 A 12/2002
(Continued)

OTHER PUBLICATIONS

Xerox ~ Phaser 850 ~ Removing Paper Jams, http://www.office.xerox.com/userdoc/ ~ Aug. 31, 2017 ~ 4 pages.

*Primary Examiner* — Jeremy R Severson
(74) *Attorney, Agent, or Firm* — HP Inc. Patent Department

(57) ABSTRACT

An example bridge module includes a media transport roller to move in a translational direction, a rotatable guide proximate to the media transport roller, a handle coupled to the rotatable guide to cause the rotatable guide to articulate into an open configuration and away from the media transport roller, and an elongated member operatively connected to the rotatable guide, the elongated member to articulate into the open configuration creating an unobstructed pathway to the media transport roller.

18 Claims, 9 Drawing Sheets

(52) U.S. Cl.
CPC ..... *B65H 2404/1442* (2013.01); *B65H 2404/611* (2013.01); *B65H 2601/11* (2013.01)

(58) Field of Classification Search
CPC .... B65H 2402/441; B65H 5/38; B65H 5/062; B65H 2404/611; G03G 2215/00544
See application file for complete search history.

(56) References Cited

U.S. PATENT DOCUMENTS

| | | | | |
|---|---|---|---|---|
| 8,356,813 | B2 * | 1/2013 | Ohkubo | B65H 5/062 271/273 |
| 9,321,603 | B1 * | 4/2016 | Nakamura | G03G 15/2064 |
| 9,731,918 | B2 * | 8/2017 | Lee | G03G 15/6511 |
| 10,124,973 | B2 * | 11/2018 | Hari | B65H 5/38 |
| 2004/0100549 | A1 | 5/2004 | Nebashi | |

FOREIGN PATENT DOCUMENTS

| | | | |
|---|---|---|---|
| JP | 2007279298 | A | 10/2007 |
| KR | 20000019808 | U | 11/2000 |
| KR | 20070019627 | A | 2/2007 |

* cited by examiner

BRIDGE MODULE GUIDES

BACKGROUND

Document machines such as printers, copiers, and some scanners typically rely on internal mechanisms to move media; e.g., paper, films, photos, etc. through the machine for output to a finisher device; e.g., for stapling or sorting, etc.

DETAILED DESCRIPTION

Internal mechanisms that help guide media in document machines may include rollers, which are often provided in pairs such that the media is fed between a driven roller rotated by a motor and a pinch roller pushed up against the driven roller to create a pinch zone or "nip". However, the media can get trapped between the rollers causing jams requiring the document machine to be opened in order to clear the jams. Finding a suitable pathway to the rollers for clearing the jams can prove to be a difficult task.

A technique is provided to allow a user to easily remove media; e.g., paper, film, fabric, etc. jams from inside a document machine such as a printer, copier, or scanner in the area between a media transport roller such as a calender roller and the output of the printer; e.g., the dead zone area, and prior to the finisher device that may be connected to the document machine. As referred to herein, the term media may refer to one or more sheets of paper or any other media suitable for insertion into a machine such as a printer, scanner, copier, or fax machine, etc.

According to an example, a bridge module comprises a media transport roller to move in a translational direction. A rotatable guide is proximate to the media transport roller. A handle is coupled to the rotatable guide to cause the rotatable guide to articulate into an open configuration and away from the media transport roller. An elongated member is operatively connected to the rotatable guide. The elongated member articulates into the open configuration creating an unobstructed pathway to the media transport roller.

In one example, the bridge module comprises a release mechanism, and the guide comprises a cover containing the handle, a cam mechanism that rotatably engages the release mechanism to cause the media transport roller to move in the translational direction, a first guide adjacent to the cover and operatively connected to the cam mechanism, and a second guide spaced apart from the first guide.

In another example, the guide comprises a first guide attached to the handle and the elongated member, a second guide operatively connected to the first guide, and a third guide attached to the elongated member, wherein actuation of the handle causes the first guide to pull the elongated member and the third guide away from the media transport roller. A mechanism may be connected to the third guide to retain the third guide in either a fully open configuration or a fully closed configuration.

Figure 1:
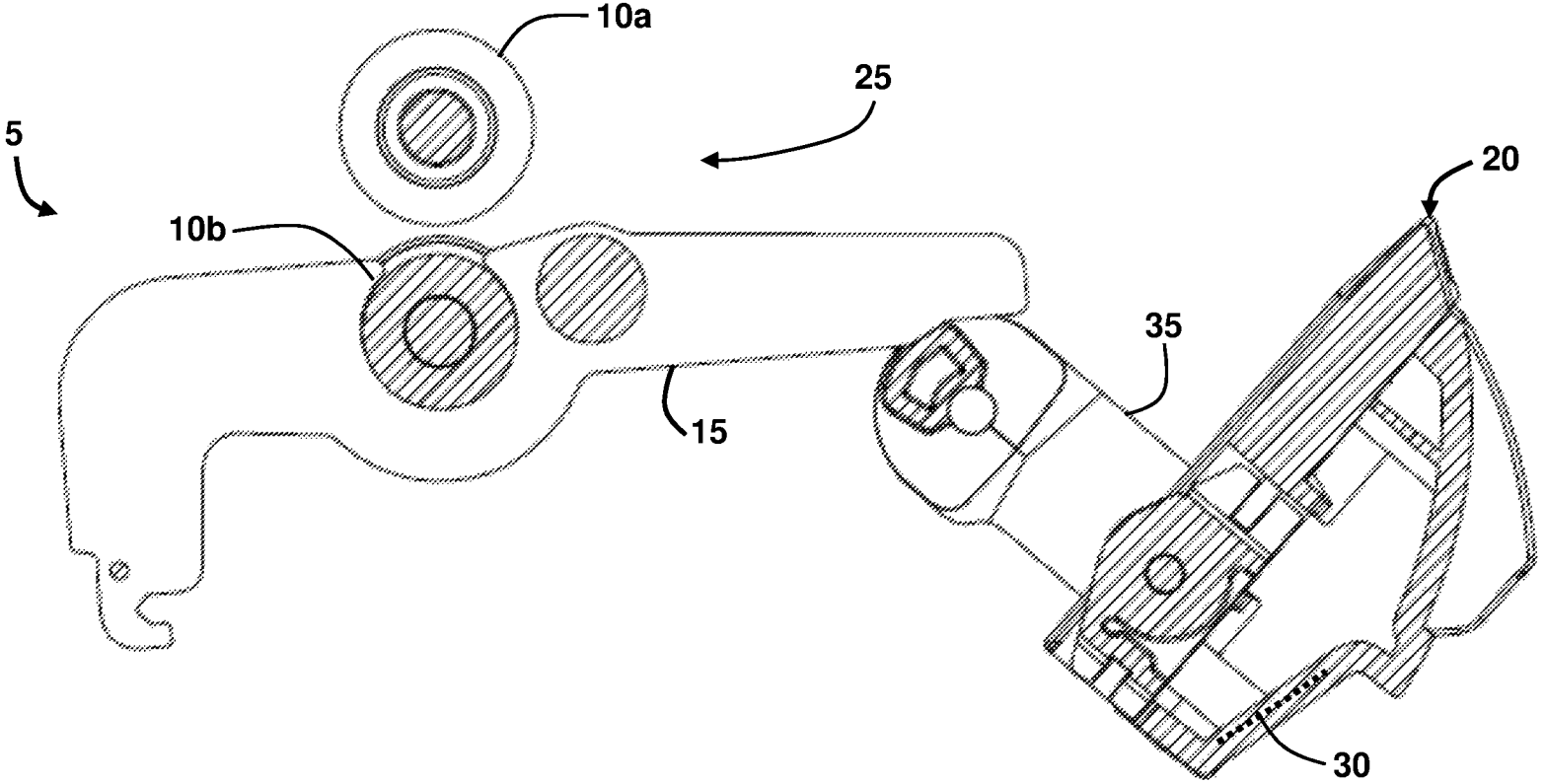
FIG. 1 is a side view illustrating a document management bridge module device, according to an example.

FIG. 1 is a side view illustrating a document management bridge module or device 5, according to an example. As described herein, the document management bridge device 5 may be used in a machine such as a printer, copier, scanner, or fax machine. For the sake of ease of description, the term printer will be used to describe any type of document management machine. However, those skilled in the art would understand that the term printer is equally applicable to any type of document management machine such as the ones described above.

According to an example, the bridge module 5 comprises a pair of media transport rollers 10*a*, 10*b*, a pinch mechanism 15 operatively connected to one of the media transport rollers 10*b* and set to rotate to separate the pair of media transport rollers 10*a*, 10*b* from one another, and a pivot or pivoting guide 20 operatively connected to the pinch mechanism 15, the pivot guide 20 set to actuate into a fully open configuration to create an unobstructed open pathway 25 to the pair of media transport rollers 10*a*, 10*b*. In one example, roller 10*b* may comprise narrower ends, which rotate within bearings, and the bearings may be held by the pinch mechanism 15. The bearings may be ball bearings or a plastic or metal bushing material, according to various examples.

The actuation of the pivot guide 20 into a fully open configuration allows a user to insert his/her hand inside the printer all the way to the pair of media transport rollers 10*a*, 10*b* to remove media, such as paper, that is jammed between the pair of media transport rollers 10*a*, 10*b*. The pivot guide 20 comprises a handle 30 to actuate the pivot guide 20, and at least one pivot arm 35 to actuate the pinch mechanism 15.

Figure 2:
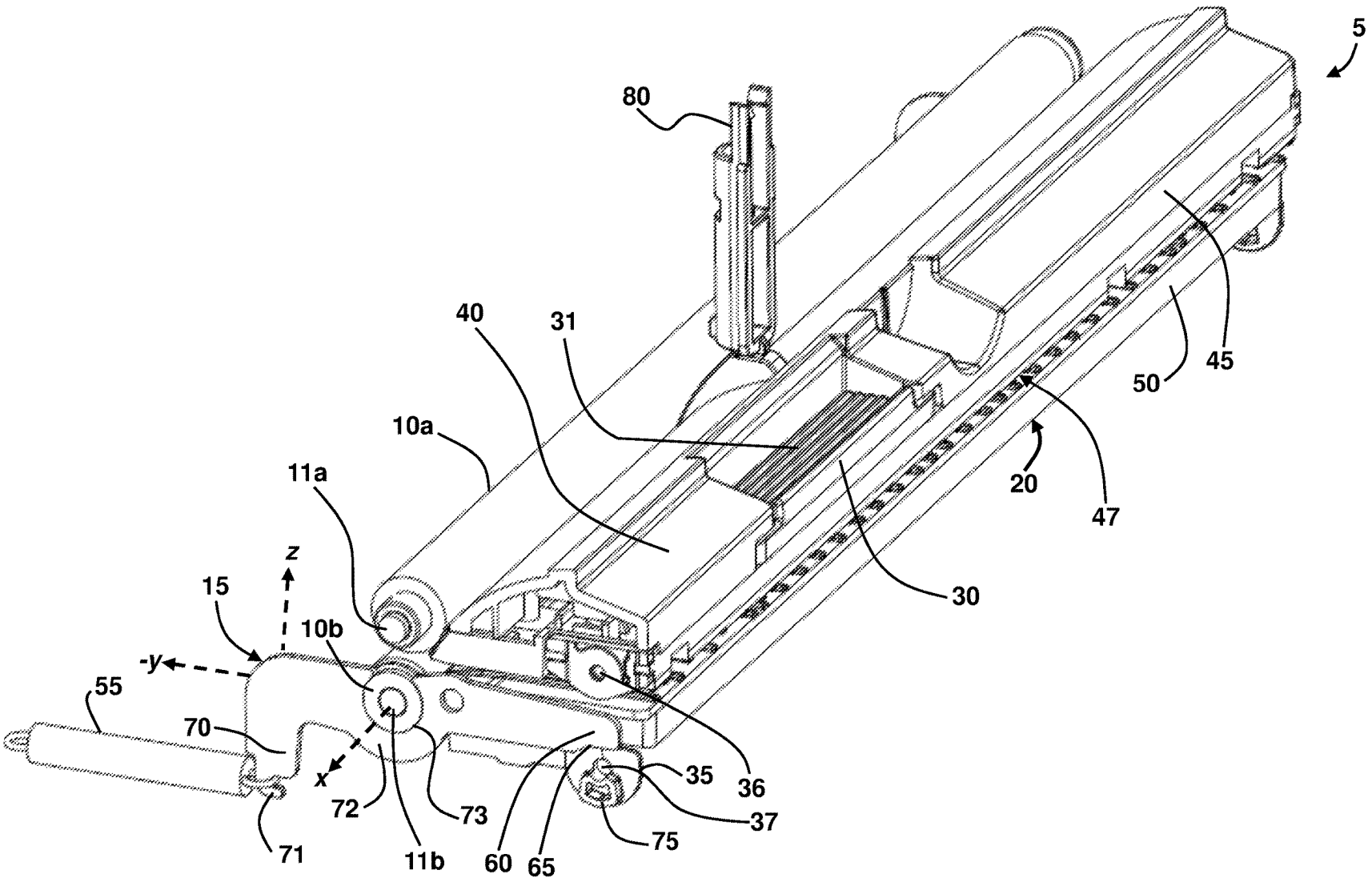
FIG. 2 is a perspective view illustrating a document management bridge module device, according to an example.

FIG. 2, with reference to FIG. 1, is a perspective view illustrating a document management bridge module device 5, according to an example. In one example, the pair of media transport rollers 10*a*, 10*b* may be generally positioned one on top of another. In other examples, depending on the positioning of the media path, the pair of media transport rollers 10*a*, 10*b* may be positioned side-by-side. In one example, both rollers 10*a*, 10*b* may rotate. In another example, one of the rollers 10*a* or 10*b* may be stationary. The rollers 10*a*, 10*b* may include a central shaft 11*a*, 11*b* to permit the rollers 10*a*, 10*b*, respectively, to rotate independent of other structures.

The pivot guide 20 comprises a cover 40 containing the handle 30, a first guide 45 adjacent to the cover 40 and operatively connected to the at least one pivot arm 35, and a second guide 50 spaced apart from the first guide 45. The cover 40 may comprise plastic or metal material and may be molded to provide a contour that fits within a document management machine. In an example, the cover 40 is on the top of the pivot guide 20, but does not necessarily extend over the entire pivot guide 20. The handle 30 is positioned along the same plane as the cover 40, according to an example, wherein the handle 30 may be integral with the cover 40. The handle 30 may comprise plastic or metal material and may include a series of ribs 31 to facilitate operation by a user. The handle 30 may be a push-type handle that is spring-loaded to actuate the pivot guide 20, in one example, wherein pushing the handle 30 triggers the pivot guide 20 to rotate. Alternatively, the handle 30 may be a pull-type handle that is linked to actuate the pivot guide 20, wherein pulling the handle 30 releases the pivot guide 20 from a closed or locked configuration into an open or unlocked configuration. Additionally, other types of handles may be used with the pivot guide 20.

The first guide 45 may be positioned below the handle 30 and cover 40 and may extend along the entire length of the cover 40, according to an example. The second guide 50 is spaced apart and below the first guide 45 and may also extend along the entire length of the cover 40 and first guide 45. A gap 47 between the first guide 45 and the second guide 50 facilitates the discharge of media exiting the machine housing the module device 5. In an example, the first guide 45 and second guide 50 may comprise plastic or metal material. The pivot arm 35 may be a link structure that is rotatably connected to the first guide 45 by a first pin or screw 36 and rotatably connected to the second guide 50 by a second pin 37, according to an example. The pivot arm 35 comprises a cam 75 positioned adjacent to the location where the second pin 37 engages the pivot arm 35. The cam 75 may comprise a raised structure compared with the pivot arm 35 to provide structural definition of the cam 75 in relation to the pivot arm 35. In an example, the pivot arm 35 and cam 37 may comprise plastic or metal material, and the cam 37 may be a separate structure adhered to the pivot arm 35. Alternatively, the cam 37 may be an integral structure with the cam 37 and structurally raised with respect to the pivot arm 35, according to an example.

The pinch mechanism 15, which may comprise plastic or metal material, may be a substantially elongated member comprising a longitudinal –y axis that is generally transverse to the longitudinal x axis of the central shaft 11*b*. A spring 55 or other type of bias member is operatively connected to the pinch mechanism 15. The spring 55 may comprise metal or other suitable material comprising an appropriately selected stiffness. The pinch mechanism 15 comprises a first portion 60 in contact with the at least one pivot arm 35, wherein the first portion 60 comprises a detent 65. In an example, the detent 65 may be a cut or angled edge of the first portion 60. Furthermore, the pinch mechanism 15 comprises a second portion 70 operatively connected to the spring 55. The second portion 70 may comprise a longitudinal z axis that is substantially transverse to the longitudinal –y axis that extends through the elongated first portion 60. Additionally, the second portion 70 may comprise a substantially hooked end 71 to engage the spring 55. The pinch mechanism 15 may further include a substantially curved third portion 72 that is positioned between the first portion 60 and the second portion 70, wherein the third portion 72 comprises a generally curved shape with the cut-out portion 73 to accommodate the bearings of media transport roller 10*b*. In one example, the third portion 72 comprises a generally C shape. In another example, the third portion 72 comprises a generally O shape completely encircling the bearings of media transport roller 10*b*. Other shapes and configurations are also possible.

The cam 75 engages the detent 65 upon sufficient rotation of the at least one pivot arm 35. In this regard, when the handle 30 is engaged causing the pivot guide 20 to rotate away from the media transport rollers 10*a*, 10*b*, then the rotation of the pivot guide 20 causes the rotatably connected pivot arm 35 to rotate in the same direction as the pivot guide 20. The rotation of the pivot arm 35 causes the cam 75 to engage the detent 65 of the first portion 60 of the pinch mechanism 15. The engagement of the cam 75 with the detent 65 causes the pinch mechanism 15 to rotate in a direction opposite to the rotation of the pivot guide 20 and the pivot arm 35. The rotation of the pinch mechanism 15 causes the media transport roller 10*b* to translate away from the media transport roller 10*a* due to the angle of rotation created by the pinch mechanism 15 and due to the engagement of the media transport roller 10*a* in the cut-out portion 73 of the pinch mechanism 15. The rotation further causes the second portion 70 of the pinch mechanism 15 to similarly rotate in the same direction as the first portion 60, which causes the second portion 70 to pull the spring 55. A latch plunger 80 is positioned adjacent to the pivot guide 20, wherein the latch plunger 80 pushes the pivot guide 20 open when the pivot guide 20 is not in a fully closed configuration. The latch plunger 80 may comprise plastic or metal material.

Figure 3A:
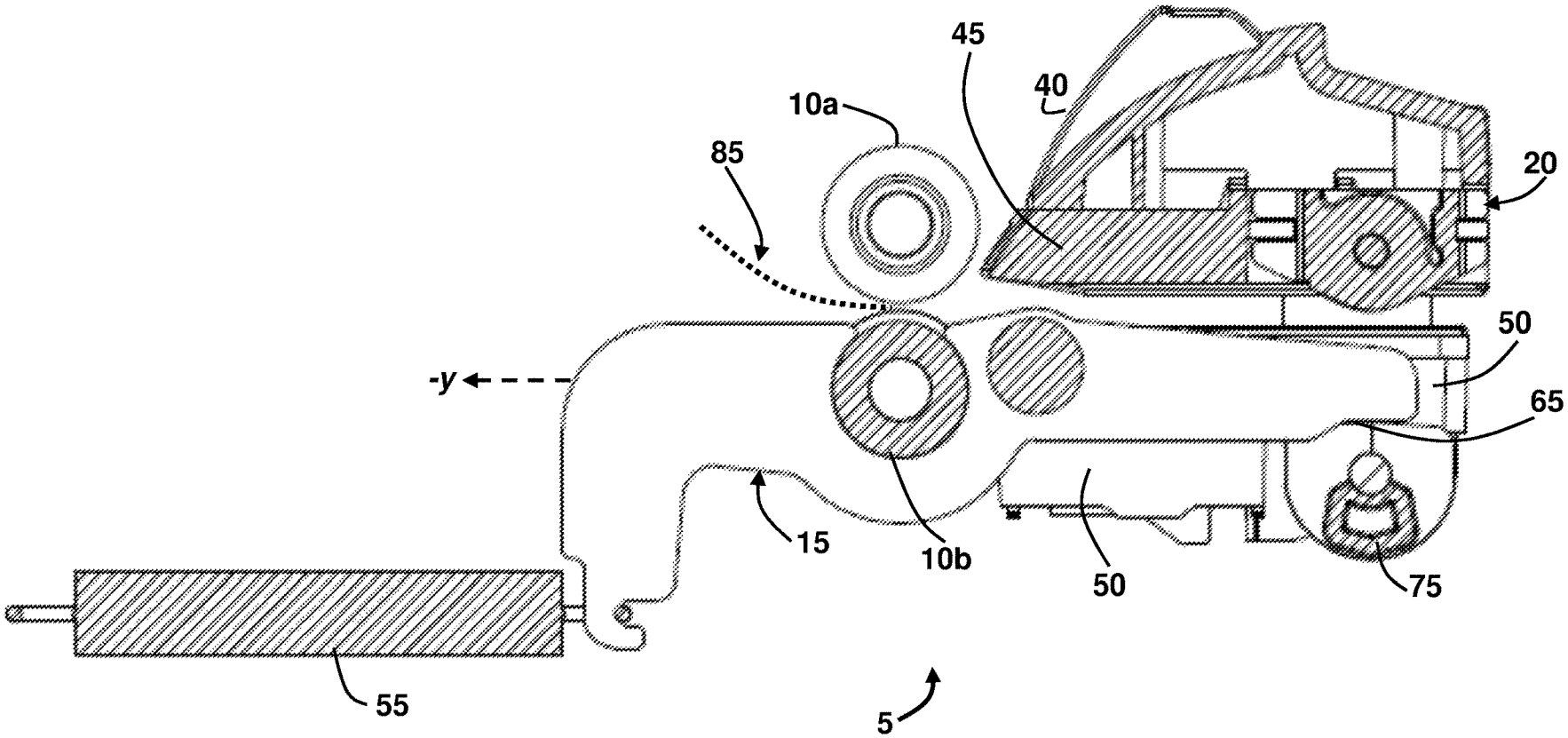
FIG. 3A is a side view illustrating a document management bridge module device in a closed configuration, according to an example.
Figure 3B:
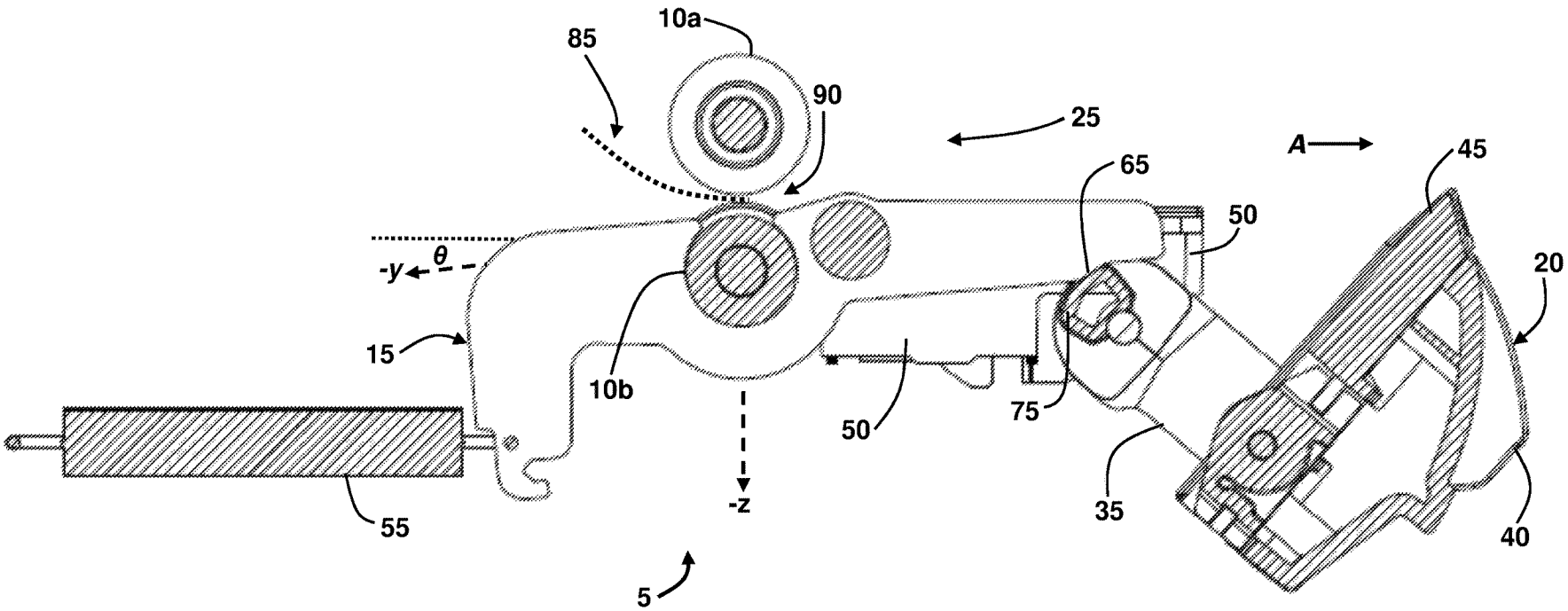
FIG. 3B is a side view illustrating a document management bridge module device in an open configuration, according to an example.
Figure 3C:
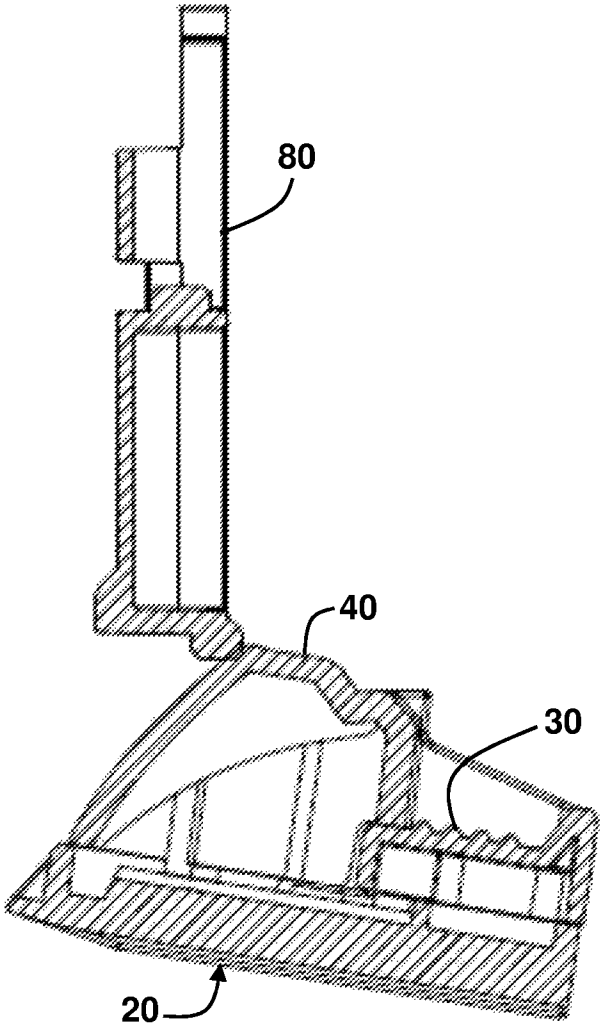
FIG. 3C is an isolated side view illustrating a pivot guide of a document management bridge module device, according to an example.

FIGS. 3A and 3B, with reference to FIGS. 1 and 2, are side views illustrating a document management bridge module device 5 in a closed configuration and an open configuration, respectively, according to an example. FIG. 3C, with reference to FIGS. 1 through 3B, is an isolated side view illustrating the pivot guide 20 of a document management bridge module device 5, according to an example. As shown, the device 5 comprises the first media transport roller 10*a* and the second media transport roller 10*b* aligned with one another to allow media 85 to pass therethrough. The media 85 may comprise paper, film, photos, or any other material capable of being printed, copied, scanned, or faxed. At least one release mechanism 15 is shown operatively connected to the second media transport roller 10*b*, and the guide 20 is shown operatively connected to the at least one release mechanism 15. The guide 20 comprises at least one cam 75 to actuate the at least one release mechanism 15, and a handle 30 to actuate the guide 20 to cause the guide 20 to articulate into an open configuration, which causes the second media transport roller 10*b* to move away from the first media transport roller 10*a* creating a gap 90 therebetween and an unobstructed pathway 25 to the first and second media transport rollers 10*a*, 10*b* from a direction A toward the guide 20. The guide 20 comprises a cover 40 containing the handle 30, a first guide 45 adjacent to the cover 40 and operatively connected to the at least one cam 75, and a second guide 50 spaced apart from the first guide 45. The at least one release mechanism 15 comprises a detent 65, wherein the at least one cam 75 engages the detent 65 upon sufficient rotation of the at least one cam 75. The latch plunger 80 is adjacent to the guide 20, wherein the latch plunger 80 holds the guide 20 in the open configuration when the guide 20 is not in a fully closed configuration. In this regard, the latch plunger 80 may push against the guide 20 to prevent the guide 20 from rotating back into the closed configuration unless pushed by a user or intervention device. In the closed configuration of the device 5 in FIG. 3A, the guide 20 is positioned adjacent to the first and second media transport rollers 10*a*, 10*b*. In the closed configuration, a user would not be able to gain access to the first and second media transport rollers 10*a*, 10*b* in order to remove jammed media 85. Moreover, in the closed configuration, the first and second media transport rollers 10*a*, 10*b* are held in contact with one another, or held in extremely close proximity to each other. In the open configuration, the guide 20 rotates away from the first and second media transport rollers 10*a*, 10*b* in a direction A.

The rotation of the guide 20 results in the cam 75 engaging the detent 65 of the release mechanism 15, which causes the release mechanism 15 to rotate as well such that the longitudinal −y axis of the release mechanism drops by a corresponding angle θ. This causes the second media transport roller 10*b* to move away from the first media transport roller 10*a* thereby creating the gap 90 between the first and second media transport rollers 10*a*, 10*b*. The outward rotation of the guide 20 with respect to the first and second media transport rollers 10*a*, 10*b* creates the unobstructed pathway 25 leading to the first and second media transport rollers 10*a*, 10*b*, which allows a user to access the media 85 that may be jammed between the first and second media transport rollers 10*a*, 10*b*. The gap 90 created by the movement of the second media transport roller 10*b* away from the first media transport roller 10*a* permits the media 85 to become dislodged and removed.

In another example, with respect to FIG. 3B, the bridge module 5 comprises the media transport roller 10*b* to move in a translational direction; e.g., −z direction. The rotatable guide 20 is proximate to the media transport roller 10*b*. The handle 30 is coupled to the rotatable guide 20 to cause the rotatable guide 20 to articulate into the open configuration and away from the media transport roller 10*b*. An elongated member, which may be the pivot arm 35, is operatively connected to the rotatable guide 20, wherein the elongated member; e.g., pivot arm 35, is to articulate into the open configuration creating the unobstructed pathway 25 to the media transport roller 10*b*. The rotatable guide 20 comprises the cover 40 containing the handle 30. The cam mechanism 75 rotatably engages the release mechanism 15 to cause the media transport roller 10*b* to move in the translational direction; e.g., −z direction. The first guide 45 is adjacent to the cover 40 and is operatively connected to the cam mechanism 75. The second guide 50 is spaced apart from the first guide 45.

Figure 4:
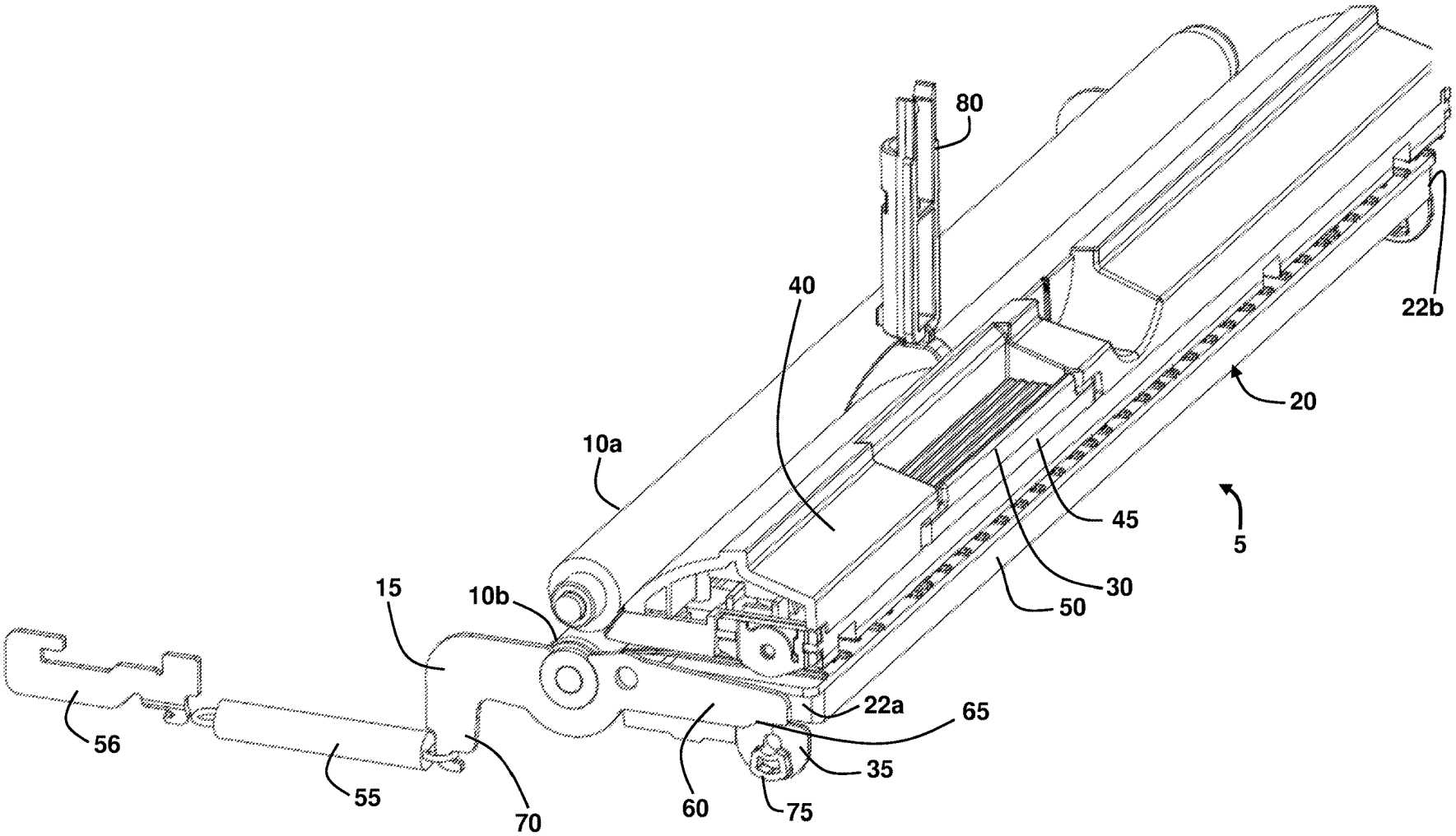
FIG. 4 is another perspective view of a document management bridge module device, according to an example.

FIG. 4, with reference to FIGS. 1 through 3C, is another perspective view of a document management bridge module device 5. As shown in FIG. 4, the spring 55 connects to a support element 56 on one side and the release mechanism 15 on the other side. The release mechanism 15, pivot arm 35, spring 55, support element 56, and cam 75 may be provided in pairs positioned at each lateral end 22*a*, 22*b* of the pivot guide 20.

Figure 5:
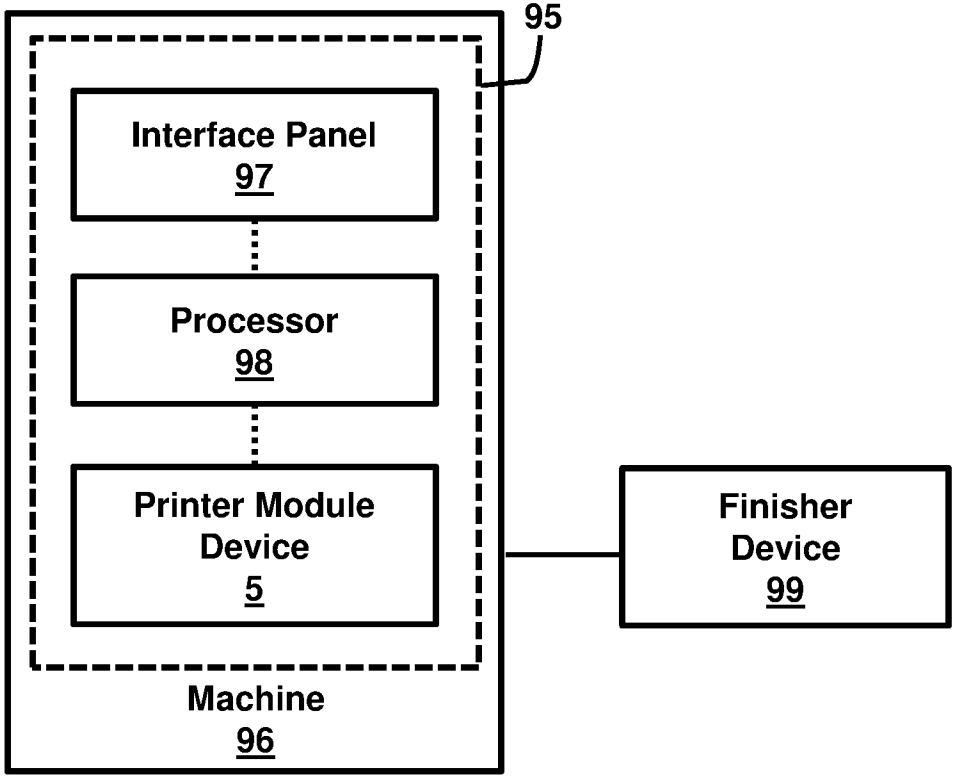
FIG. 5 is a system block diagram, according to an example.

FIG. 5, with reference to FIGS. 1 through 4, is a block diagram illustrating a system 95 including the printer module device 5 and an interface panel 97 that displays a notice about a state of operation of the open configuration. A processor 98 may receive instructions from the printer module device 5 or accompanying sensors, and may relay instructions to the interface panel 97 pertaining to the state of operation of the printer module device 5. For example, the interface panel 97 may indicate that the pair of media transport rollers 10*a*, 10*b*, which are aligned with one another, contain a media jam therebetween. The interface panel 97 may indicate that the rotation mechanism 15, which is operatively connected to one of the media transport rollers 10*b*, and that the pivoting guide 20, which is operatively connected to the rotation mechanism 15, are in a closed configuration; e.g., no rotation. Once a user opens the machine 96 for access to the device 5, and causes the pivoting guide 20 to rotate by engaging the handle 30 in order to actuate the pivoting guide 20, then the interface panel 97 may similarly provide a schematic showing this actuation or indicate through audio or other visual means that the actuation of the pivoting guide 20 is occurring.

The interface panel 97 may similarly depict the cam mechanism 75 rotatably engaging the rotation mechanism 15 to cause the rotation mechanism 15 to separate the pair of media transport rollers 10*a*, 10*b* from one another. The latch plunger 80, which is adjacent to the pivoting guide 20, as well as the spring 55 that is connected to the rotation mechanism 15 may also be depicted on the interface panel 97. Any of the latch plunger 80 and the spring 55 may hold the pivoting guide 20 in an open configuration. In this regard, the latch plunger 80 may hold the pivoting guide 20 outwardly rotated and preventing automatic and unintended reverse rotation of the pivoting guide 20 from occurring until a user or intervention device pushes the pivoting guide 20 back into the closed configuration. Similarly, the spring 55 may be used to hold the pivoting guide 20 in its open configuration. Because the open configuration creates an unobstructed open pathway 25 to the pair of media transport rollers 10*a*, 10*b*, the latch plunger 80 or spring 55 may allow the user to access the pair of media transport rollers 10*a*,10*b* without fear of having the pivoting guide 20 begin to close while the user's hands are in the machine 96. In an example, if the pivoting guide 20 is not fully latched closed by a user or an intervention device, the latch plunger 80 will push the pivoting guide 20 back out to a mostly open configuration. In this open configuration, the pivoting guide 20 may wedge itself into a corresponding media pathway of an adjacent finisher device 99, thus preventing the finisher device 99 from latching properly to the machine 96. This clearly signals to the user that the pivoting guide 20 is not fully latched closed. All of these actions, as well as others described herein, may be presented on the interface panel 97, which may be provided on the machine 96 or remotely located and accessible on a computing or communication device.

The pivoting guide 20 may be snapped back into position by counter-rotating and pushing it into the printer module device 5. If the pivoting guide 20 is not properly snapped into position, then it will not permit the finisher device 99 to align and connect with the printer; i.e., machine 96. In this example, the machine 96 does not have to rely on sensors to indicate proper positioning of the pivoting guide 20. In another example, where sensors may be utilized, the printer's control interface panel 97 may provide notice and indicate an animation as to the status of the printer module device 5 including any media jams and the positioning of the pivoting guide 20.

Figure 6A:
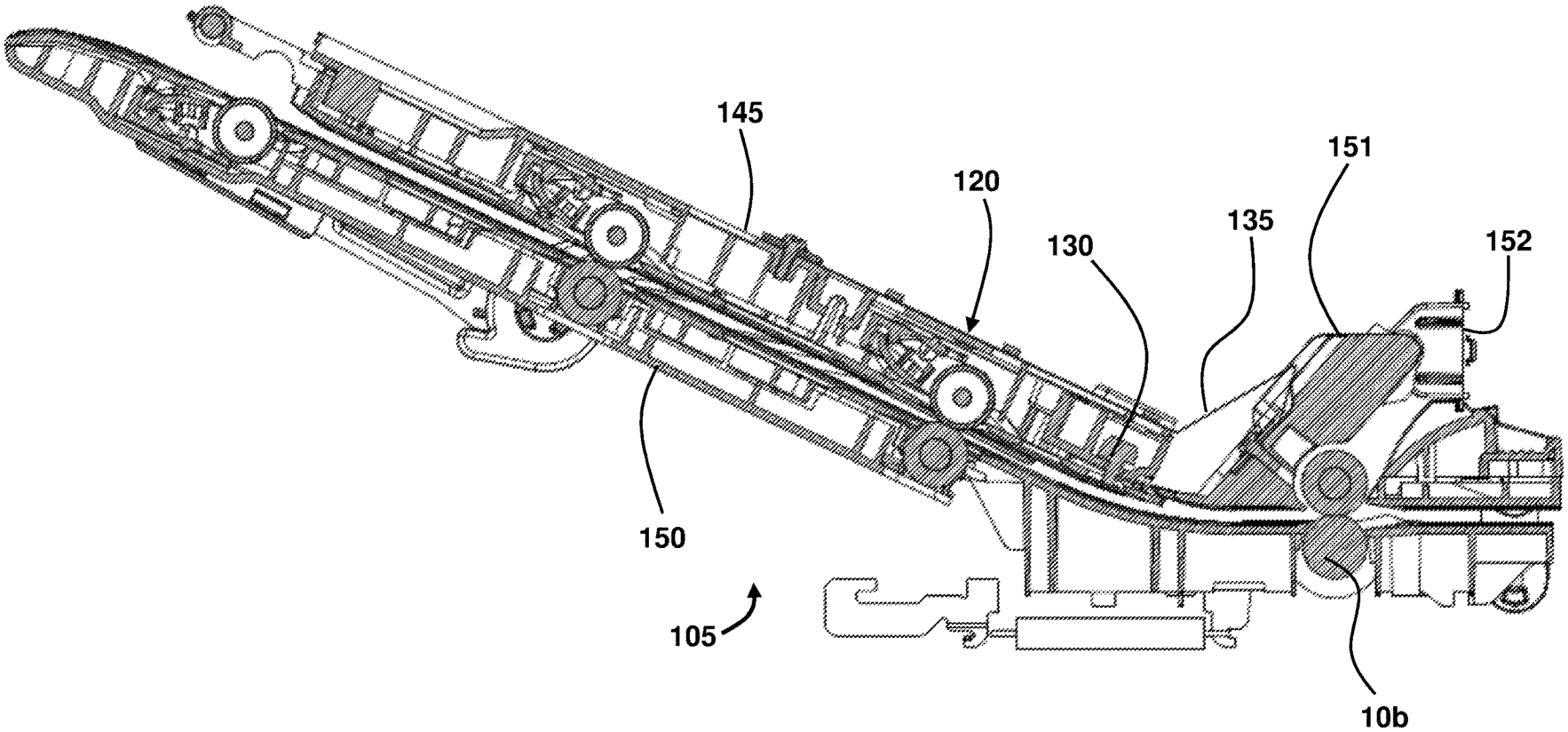
FIG. 6A is a side view of a bridge module in a closed configuration, according to an example.
Figure 6B:
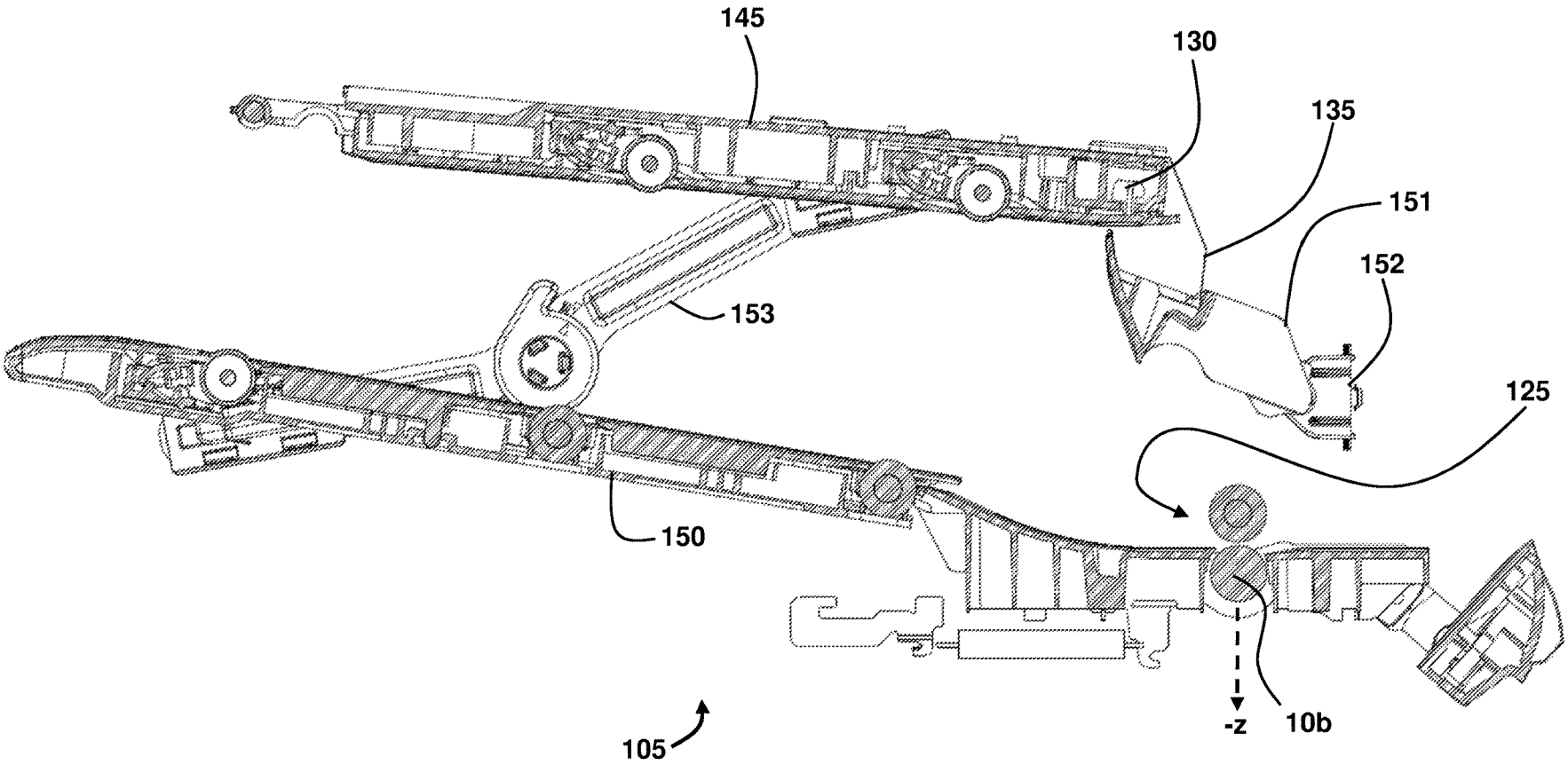
FIG. 6B is a side view of a bridge module in an open configuration, according to an example.

FIGS. 6A and 6B, with reference to FIGS. 1 through 5 are side views of a bridge module 105 according to an example. The bridge module 105 comprises a media transport roller 10*b* to move in a translational direction; e.g., −z direction. A rotatable guide 120 is proximate to the media transport roller 10*b*. A handle 130 is coupled to the rotatable guide 120 to cause the rotatable guide 20 to articulate into an open configuration and away from the media transport roller 10*b*. An elongated member 135 is operatively connected to the rotatable guide 120, wherein the elongated member 135 is to articulate into the open configuration creating an unobstructed pathway 125 to media transport roller 10*b*. In an example, the elongated member 135 comprises a bendable strap.

The rotatable guide 120 comprises a first guide 145 attached to the handle 130 and the elongated member 135. A second guide 150 is operatively connected to the first guide 145. A third guide 151 is attached to the elongated member 135, wherein actuation of the handle 130 causes the first guide 145 to pull the elongated member 135 and the third guide 151 away from the media transport roller 10*b*. A linking member 153 connects the first guide 145 to the second guide 150, and the elongated member 135 connects the first guide 145 to the third guide 151. In an example, lifting the handle 130 lifts the first guide 145 away from the media transport roller 10*b*. This causes the second guide 150, which is operatively connected to the first guide 145 through the linking member 153, to lower away from the first guide 145. In an example, the elongated member 135, which may be a flexible or bendable strap, goes from a bent configuration, as shown in FIG. 6A, to a substantially straight configuration, as shown in FIG. 6B. The straightening of the elongated member 135 pulls the third guide 151 upwards. A mechanism 152 may be connected to the third guide 151 to retain the third guide 151 in either a fully open configuration or a fully closed configuration. The mechanism 152 may be connected to the document management device or some other component, which suitably provides structural support. In an example, the mechanism 152 biases the third guide 151 either fully open or fully closed, but not in between; i.e., not partially open or partially closed. In one example, the third guide 151 is rotatably connected to the mechanism 152 such that when the first guide 145 pulls the elongated member 135, the third guide 151 rotates with respect to the mechanism 152 and thus rotates away from the media transport roller 10*b*.

When the handle 130 is lowered, the connected first guide 145 also lowers, which causes the second guide 150 to be lifted due to the rotation of the linking member 153. The lowering of the handle 130 and first guide 145 further causes the elongated member 135 to become bent, and the third guide 151 lowers by rotating towards the media transport roller 10*b*. According to some examples, the various components of the bridge module 105 may comprise plastic or metal material.

In an example, the mechanism 152 may control the third guide 151 such that the mechanism 152 may be a pin in a track on the first guide 145, and the elongated member 135 may comprise a bias element such as an over-center spring that either opens or closes the third guide 151 as the first guide 145 is opened or closed. In another example, the third guide 151 may be attached to the end of the first guide 145 and rotates in an opened or closed position using the elongated member 135 and mechanism 152 set as a pin, track, and spring, etc. as described above.

The present disclosure has been shown and described with reference to the foregoing exemplary implementations. Although specific examples have been illustrated and described herein it is manifestly intended that the scope of the claimed subject matter be limited only by the following claims and equivalents thereof. It is to be understood, however, that other forms, details, and examples may be made without departing from the spirit and scope of the disclosure that is defined in the following claims.

What is claimed is:

1. A bridge module comprising:

a pair of media transport rollers;

a pinch mechanism operatively connected to one of the media transport rollers; and a pivot guide operatively connected to the pinch mechanism, the pivot guide including a first guide and a second guide spaced to guide media therebetween, and a pivot arm connected to the first guide, the first guide and the pivot arm to rotate in a first direction to cause the pivot arm to contact and rotate the pinch mechanism in a second direction opposite the first direction to separate the pair of media transport rollers from one another.

2. The bridge module of claim 1, comprising a spring operatively connected to the pinch mechanism.

3. The bridge module of claim 2, wherein the pinch mechanism comprises:

a first portion in contact with the pivot arm, wherein the first portion comprises a detent; and a second portion operatively connected to the spring.

4. The bridge module of claim 3, wherein the pivot arm comprises a cam.

5. The bridge module of claim 4, wherein the cam engages the detent upon sufficient rotation of the pivot arm.

6. The bridge module of claim 1, comprising a latch plunger adjacent to the pivot guide.

7. The bridge module of claim 6, wherein the latch plunger pushes the pivot guide open when the pivot guide is not in a fully closed configuration.

8. The bridge module of claim 1, wherein the pivot guide comprises:

a handle to actuate the pivot guide.

9. A system comprising:

a pair of media transport rollers aligned with one another;

a rotation mechanism operatively connected to one of the media transport rollers;

a pivoting guide operatively connected to the rotation mechanism, the pivoting guide comprising:

a first guide and a second guide spaced to guide media therebetween; and a cam mechanism operatively connected to the first guide, the first guide and the cam mechanism rotatable in a first direction such that the cam mechanism rotatably engages the rotation mechanism to cause the rotation mechanism to rotate in a second direction opposite the first direction to separate the pair of media transport rollers from one another.

10. The system of claim 9, wherein the first guide and the cam mechanism are rotatable in the first direction to an open configuration, and the open configuration creates an unobstructed open pathway to the pair of media transport rollers.

11. The system of claim 10, comprising an interface panel that displays a notice about a state of operation of the open configuration.

12. The system of claim 9, comprising a handle to actuate the pivoting guide.

13. The system of claim 9, comprising a latch plunger adjacent to the pivoting guide; and a spring connected to the rotation mechanism, with any of the plunger and the spring to hold the pivoting guide in an open configuration.

14. A bridge module comprising:

a media transport roller to rotate and to move in a translational direction;

a first guide proximate to the media transport roller and a second guide spaced from the first guide, the first guide and the second guide to guide media therebetween;

a release mechanism operatively connected to the media transport roller; and a cam mechanism operatively connected to the first guide, the first guide and the cam mechanism rotatable in a first direction to engage the release mechanism and rotate the release mechanism in a second direction opposite the first direction to cause the media transport roller to move in the translational direction.

15. The bridge module of claim 14, wherein the bridge module further comprises:

a first bridge module guide;

a second bridge module guide operatively connected to the first bridge module guide;

a handle coupled to the first bridge module guide;

an elongated member operatively connected to the first bridge module guide; and a third bridge module guide attached to the elongated member, wherein actuation of the handle causes the first bridge module guide to pull the elongated member and the third bridge module guide away from the media transport roller.

16. The bridge module of claim 15, comprising a mechanism connected to the third bridge module guide to retain the third bridge module guide in either a fully open configuration or a fully closed configuration.

17. The bridge module of claim 15, wherein actuation of the handle causes the first bridge module guide and the second bridge module guide to articulate into an open configuration.

18. The bridge module of claim 15, wherein the elongated member articulates into the open configuration to create an unobstructed pathway to the media transport roller.

* * * * *